United States Patent [19]

Geiger

[11] Patent Number: 4,464,873

[45] Date of Patent: Aug. 14, 1984

[54] WALL PANEL SYSTEM

[76] Inventor: Lee S. Geiger, 304 San Marco, Rapid City, S. Dak. 57701

[21] Appl. No.: 457,913

[22] Filed: Jan. 14, 1983

[51] Int. Cl.[3] ..... E02D 27/00

[52] U.S. Cl. ..... 52/293; 52/169.1; 52/404

[58] Field of Search ..... 52/293, 292, 299, 169.1, 52/404, 743

[56] References Cited

U.S. PATENT DOCUMENTS

| | | | |
|---|---|---|---|
| 3,216,163 | 11/1965 | Carew | 52/293 X |
| 4,027,439 | 6/1977 | Willard | 52/293 X |
| 4,263,762 | 4/1981 | Reed | 52/293 |
| 4,310,992 | 1/1982 | Thabet | 52/293 X |

*Primary Examiner*—J. Karl Bell

*Attorney, Agent, or Firm*—Merchant, Gould, Smith, Edell, Welter & Schmidt

[57] ABSTRACT

A wall panel (10) for use as a foundation and upper wall is disclosed. The wall panel (10) comprises a plurality of spaced first framing members (11) having top ends, (11*a*) bottom ends (11*b*), first edges (11*c*) and second edges (11*d*). A plurality of spaced second framing members (12), having top ends (12*a*), bottom ends (12*b*), first edges (12*c*) and second edges (12*d*) are provided. The spacing between the first framing members (11) is substantially equal to the spacing between the second framing members (12). The bottom ends (12*b*) of the second framing members (12) are positioned on top of the top ends (11*a*) of the first framing members (11). Means for fastening the first framing members (11) to the second framing members (12) are provided. Foundation grade treated sheathing (17) are cooperatively connected to the first edge (11*a*) of the first framing members. External sheathing (18) is cooperatively connected to the first edge (12*c*) of the second framing member (12). In a preferred embodiment, the fastening means comprises steel straps (13) and gang nail connectors (14) for cooperatively connecting the top end (11*a*) of the first framing members (11) to the bottom ends (12*b*) of the second framing members (12).

25 Claims, 5 Drawing Figures

FIG. 1
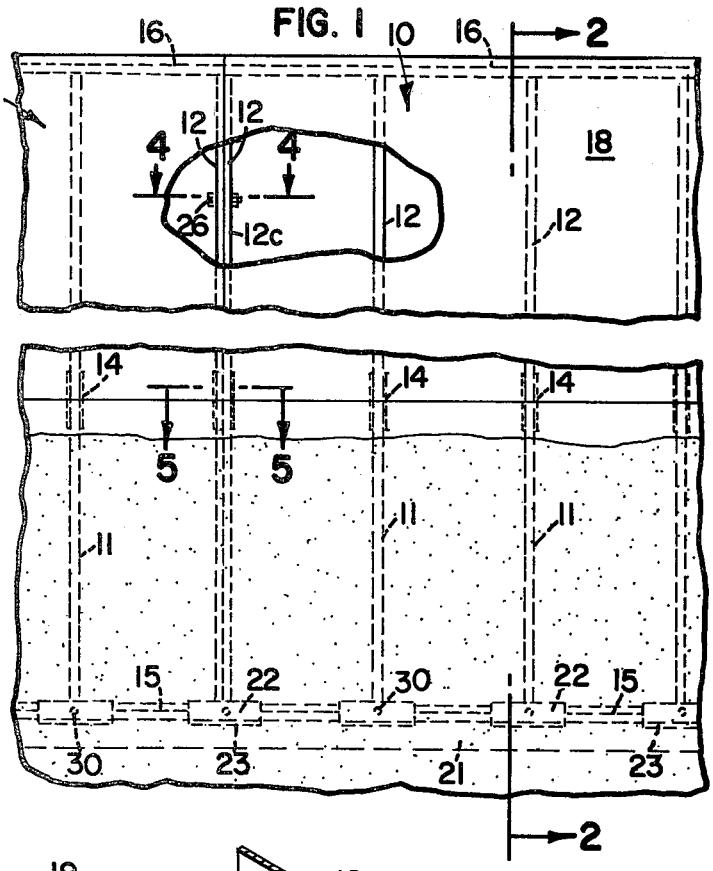
FIG.2
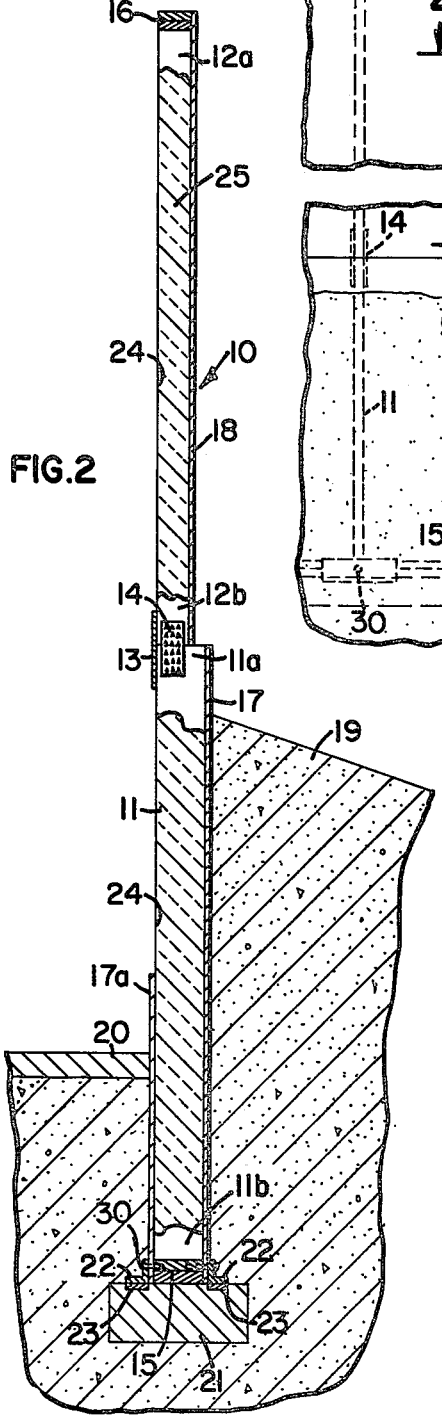
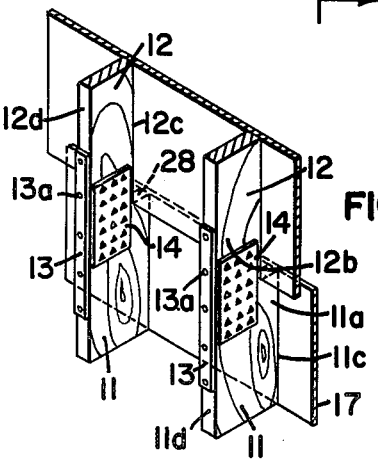
FIG. 3
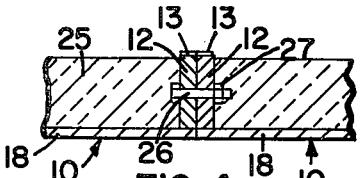
FIG. 4

WALL PANEL SYSTEM

BACKGROUND OF THE INVENTION

1. Field of the Invention

This invention relates generally to a wood building construction and more specifically to a wall panel system for use as both the foundation and upper wall of a building.

2. Description of the Prior Art

While in the past most buildings have had concrete foundations, with the development of pretreated lumber it is now possible and often beneficial to use wood products below grade in building constructions. In building a typical wood foundation, the foundation is stick built on site. The foundation comprises two bottom plates and a top plate connected by a plurality of studs. Pretreated plywood is then secured to the studs. The concrete slab for the basement floor is positioned proximate the bottom plate. The floor joist for the first floor are fastened to the top plate. The remainder of the house is then finished in a normal manner.

One of the disadvantages associated with such a wood foundation is that there are numerous steps that need to be taken to complete the foundation and upper walls. First of all, the foundation is built as a single wall and topped by a top plate. The upper wall is then cooperatively connected to the top of the wood foundation. This creates extra steps to be performed on site, thereby increasing the total cost of the building. Another disadvantage is that any insulation that is put into the foundation wall and the upper wall is separated by the top plate. The insulation is not continuous, thereby providing for the opportunity for air leaks and uninsulated spaces. With today's energy concern, such a factor is quite important in the overall energy design of a building.

Brief Description of the Invention

The present invention provides a wall panel system for use as both a foundation and upper wall. The wall panel includes a plurality of spaced first framing members having top and bottom ends and first and second edges. A plurality of spaced second framing members, having top and bottom ends and first and second edges are also provided. The spacing between the first framing members is substantially equal to the spacing between the second framing members. The bottom ends of the second framing members are positioned on top of the top ends of the first framing members. Means for fastening the first framing members to the second framing members is provided. In a preferred embodiment, the fastening means includes a steel strap, having a plurality of holes, cooperatively connected to the top end of the first framing member and the bottom end of the second framing member. The fastening means also includes a gang nail connector cooperatively connected to the top end of the first framing member and the bottom end of the second framing member. A foundation grade treated sheathing is cooperatively connected to the first edge of the first framing member and an external sheathing is cooperatively connected to the first edge of the second framing member.

BRIEF DESCRIPTION OF THE DRAWINGS

FIG. 1 is a front elevation view of the wall panel of the present invention;

FIG. 2 is a cross-sectional view of the wall panel of FIG. 1, taken generally along the lines 2—2;

FIG. 3 is a perspective view of a portion of the wall panel of FIG. 1 showing the fastening between the first and second framing members;

FIG. 4 is an enlarged cross-sectional view of the wall panel of FIG. 1, taken generally along the lines 4—4.

DESCRIPTION OF THE PREFERRED EMBODIMENT

Figure 5:
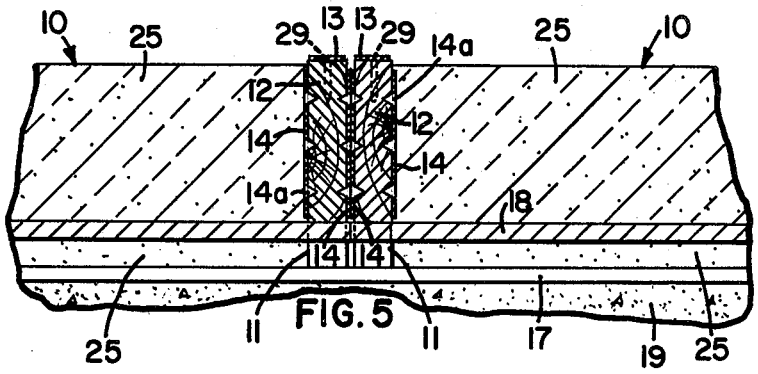
FIG. 5 is an enlarged cross-sectional view of the wall panel of FIG. 1, taken generally along the lines 5—5.

Referring to the drawing, wherein like numerals represent like parts throughout the several views, there is generally designated at 10, a wall panel. In FIG. 1, a portion of two wall panels 10 are shown connected. As will be more fully described hereinafter, the wall panels may vary in width and height, but typically are eight feet wide and sixteen feet in length. The wall panel 10 comprises a plurality of first framing members 11. The framing members 11 have a top end 11*a*, bottom end 11*b*, first edge 11*c* and second edge 11*d*. A plurality of spaced second framing members 12 have a top end 12*a*, bottom end 12*b*, first edge 12*c* and second edge 12*d*. The spacing between the first framing members 11 and second framing members 12 are substantially equal and typically are on sixteen inch or twenty-four inch centers. It is understood that this spacing may vary depending upon the design of the building for which the wall panel is used. The bottom ends 12*b* of the second framing members 12 are positioned on top of the top ends 11*a* of the first framing members 11. The first framing members 11 are fastened to the second framing members 12.

In a preferred embodiment, the first framing members 11 are fastened to the second framing members 12 by means of a steel strap 13 and gang nail connector 14. The steel strap 13 has a plurality of holes 13*a* formed therein. The steel strap 13 is secured to the second surface 12*d* at the bottom end 12*d* of the second framing member and the second surface 11*d* at the top end 11*a* of the first framing member by means of a plurality of nails 29 through the holes 13*a*. Gang nail connectors 14 are likewise connected to the bottom end 12*b* of the second framing member and the top end 11*a* of the first framing member to securely fasten and align the first and second framing members 11 and 12. Gang nail connectors are well-known in the art. A plurality of triangular tabs 14*a* are forced out 90° from a sheet of galvanized sheet metal. The tabs 14*a* are still connected on one side of the triangle. Gang nail connectors 14 are used on both sides of the abutting framing members 11 and 12. The gang nail connectors 14 are installed by applying pressure to the gang nail connectors 14 and forcing the triangular tabs 14*a* into the framing members 11 and 12.

A double bottom plate 15 is secured to the bottom end 11*b* of the first framing members 11. A double top plate 16 is cooperatively connected to the top end 12*a* of the second framing members 12. The top plates 16 and bottom plates 15 may be secured to the framing members by nails or other appropriate means, well-known in the industry. The top plate 16 and bottom plate 15 extend the total width of the wall panel 10.

The size of the wooden framing members 11 and 12 will vary depending on the structural requirements of the building being built. In a preferred embodiment, the framing members 11 are 2×8's and the framing members 12 are 2×6's. While it is understood that the framing members 11 and 12 may be the same size, the resulting offset 28 from the differences in size is advantageous, as will be more fully discussed hereinafter. The wooden top plate 16 and bottom plate 15 are sized, depending on the size of the framing members 12 and 11 respectively, to the same width as the framing members 12 and 11 respectively.

The width of the wall panel 10 may vary depending upon the individual design of the building. Typically, the panel would be eight feet wide. If the framing members 11 and 12 are on sixteen inch centers, the wall panel 10 would comprise seven sets of spaced framing members 11 and 12 each connected at the middle by the steel straps 13 and gang nail connectors 14 and at the top by the top plate 16 and at the bottom by the bottom plate 15. The length of the panel 10 may also vary, but is typically at least sixteen feet long. This would allow for a basement and first floor each 8 feet in height.

A foundation grade treated sheathing panel 17 is fastened to the first edge 11*c* of the first framing members 11. Foundation grade treated sheathing panels 17 are well-known in the art and any appropriate treated panel may be used. The treated sheathing is fastened to the framing members 11 by nails or other fastening means, well-known in the art. The size of the wall panel 10 would of course dictate the number of treated sheathing panels 17 that are required to cover the first framing members 11. The treated sheathing panels 17 are required wherever the wall panel 10 will be below grade and in contact with the earth 19. Further, it is preferred that the treated panel 17 extend above the earth berm 19 by approximately 12 inches. External sheathing 18, such as plywood or any rigid sheathing material is cooperatively connected to the first edge 12*c* of the second framing member 12 to cover the rest of the wall panel 10. The type of external sheathing 18 will depend on the structural requirements of the building design.

If the concrete slab 20, to be used as a floor, is located above the footings 21 another foundation treated sheathing panel 17*a* is secured to the second edge 11*d* of the framing members 11. The treated sheath 11 extends above the point where the slab 20 will come in contact with the wall panel 10. As will be more fully discussed later, while it is preferred that the wall panel 10 be prefabricated, the sheathing 17*a* may be installed on site, even if the panel 10 is prefabricated. This insures that only treated sheathing will come in contact with the earth. The remainder of the back side of the wall panel 10 may be covered by attaching any appropriate indoor finishing material to the remainder of the second edges 11*d* of the first framing members 11 and the second edges 12*d* of the second framing members.

Two steel base angles 22 are fastened to the bottom end 11*b* of the first framing member 11 by means of a lag screw 30. The footings 21 have steel plates 23 embedded therein. The steel base angles 22 are welded to the steel plates 23, thereby securing the wall panel 10 to the footings 21 and aligning the wall panels 10 in a vertical plane.

The first framing members 11 and second framing members 12 form a continuous cavity 24, into which insulation 25 may be installed. The cavity 24 is continuous from the top plate 16 to the bottom plate 15. Therefore, the insulation 25 that is installed may be continuous with no break where the first framing members 11 are secured to the second framing members 12.

As shown in FIG. 4, abutting wall panels 10 are fastened to each other by means of a thru bolt 26, nut 27, and a washer (not shown). This connection is made in a number of places along the framing members 11 and 12. Typically, four such connections are made in a 16 foot panel.

While it is understood that the wall panel 10 may be constructed on site, it is preferable that the wall panel 10 be prefabricated in a factory. The wall panels 10 may then be constructed at the factory and shipped to the building site for installation. The wall panels 10 allow for installation at the site of a single panel, and not two as in the prior art, to form both the foundation and upper wall of the building. The prefabrication of a single panel for both the foundation and the upper wall provide for reduced steps at the construction site, and therefore reduced cost.

After installation of the wall panel 10, another floor (not shown) may be installed by an appropriate method above the concrete slate 20. Taking advantage of the offset 28 created by the differences and width between the first framing member 11 and second framing member 12, a header a band joist may be secured to the offset 28, thereby allowing for the installation of another floor. One other alternate method of securing the first floor to the wall panel 10, would be to use standard balloon framing.

It is understood that a roof may be added by any appropriate method, well-known in the art.

Other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follows in the spirit and broad scope of the appended claims are included.

I claim:

1. A wall panel system for use as a foundation and upper wall comprising:

(a) a plurality of spaced first framing members having top ends and bottom ends and first and second edges;

(b) a plurality of spaced second framing members having top ends and bottom ends and first and second edges, said spacing between said first framing members being substantially equal to said spacing between said second framing members, said bottom ends of said second framing members positioned on top of said top ends of said first framing members;

(c) means for fastening said first framing members to said second framing members;

(d) foundation grade treated sheathing cooperatively connected to said first edge of said first framing member; and (e) external sheathing cooperatively connected to said first edge of said second framing member.

2. The wall panel system of claim 1, further comprising a bottom plate cooperatively connected to said bottom end of said first framing member.

3. The wall panel system of claim 1, further comprising a top plate cooperatively connected to said top end of said second framing member.

4. The wall panel system of claim 1, wherein said fastening means comprising a steel strap having a plurality of holes cooperatively connected to said top end of said first framing member and said bottom end of said second framing member.

5. The wall panel system of claim 4, wherein said fastening means further comprises a gang nail connector cooperatively connected to said top end of said first framing member and said bottom end of said second framing member.

6. The wall panel system of claim 1, further comprising means for securing said bottom ends of said first framing member to a footing.

7. The wall panel system of claim 6, wherein said securing means comprises an angle cooperatively connected to said bottom end of said first framing member for welding to a steel plate embedded in the footing, whereby said wall panel is aligned in the vertical plane.

8. The wall panel system of claim 1, wherein said first and second framing members form a continuous cavity, whereby any insulation installed may be continuous from said top end of said second framing members to said bottom end of said second framing members.

9. The wall panel system of claim 1, further comprising foundation grade sheathing cooperatively connected to said second edge of said first framing member.

10. A wall panel system for use as a foundation and upper wall comprising:

(a) a plurality of spaced first framing members having top ends and bottom ends and first and second edges;

(b) a plurality of spaced second framing members having top ends and bottom ends and first and second edges, said spacing between said first framing members being substantially equal to said spacing between said second framing members, said bottom ends of said second framing members positioned on top of said top ends of said first framing members;

(c) a steel strap having a plurality of holes, cooperatively connected to said top end of said first framing member and said bottom end of said second framing member and a gang nail connector cooperatively connected to said top of said first framing member and said bottom of said second framing member, whereby said first framing member is fastened to said second framing member;

(d) foundation grade treated sheathing cooperatively connected to said first edge of said first framing member;

(e) external sheathing cooperatively connected to said first edge of said second framing member;

(f) an angle cooperatively connected to said bottom end of said first framing member for welding to a steel plate embedded in the footing, whereby said wall panel is aligned in the vertical plane;

(g) a bottom plate cooperatively connected to said bottom end of said first framing member;

(h) a top plate cooperatively connected to said top end of said second framing member; and (i) said first and second framing members form a continuous cavity, whereby any insulation installed may be continuous from said top end of said second framing members to said bottom end of said second framing members.

11. A prefabricated wall panel for use as both a foundation for a building and an upper wall, comprising:

(a) a plurality of spaced rigid framing members, each of said framing members having a top section and a bottom section, said top and bottom sections forming said rigid framing members;

(b) a foundation grade treated sheathing cooperatively connected to said bottom section;

(c) an external sheathing cooperatively connected to said top section; and (d) means for securing said framing member to a footing, whereby said wall panel may be easily and quickly installed and when a plurality of said wall panels are abutted edge to edge, said wall panels form both the foundation and upper wall in a single step.

12. The prefabricated wall panel of claim 11, further comprising a bottom plate cooperatively connected to said bottom section and a top plate cooperatively connected to said top section.

13. The prefabricated wall panel of claim 11, wherein said top and bottom sections are fastened together by a steel strap having a plurality of holes, cooperatively connected to said top and bottom sections.

14. The prefabricated wall panel of claim 13, wherein said top and bottom sections are further fastened together by a gang nail connector cooperatively connected to said top and bottom sections of said framing member.

15. The prefabricated wall panel of claim 11, wherein said securing means comprising an angle cooperatively connected to said bottom section of said framing member for welding to a steel plate embedded in the footing, whereby said wall panel is aligned in the vertical plane.

16. The prefabricated wall panel of claim 11, wherein adjacent said framing members form a continuous cavity, whereby any insulation installed may be continuous from said top section to said bottom section of said framing member.

17. A wall framing system for use as a frame for both foundation and upper wall comprising:

(a) a plurality of spaced first framing members having top ends and bottom ends and first and second edges;

(b) a plurality of spaced second framing members having top ends and bottom ends and first and second edges, said spacing between said first framing members being substantially equal to said spacing between said second framing members, said bottom ends of said second framing members positioned on top of said top ends of said first framing members; and (c) means for fastening said first framing members to said second framing members; whereby foundation grade treated sheathing may be cooperatively connected to said first edge of said first framing member, and external sheathing cooperatively may be connected to said first edge of said second framing member.

18. The wall framing system of claim 17, further comprising a bottom plate cooperatively connected to said bottom end of said first framing member.

19. The wall framing system of claim 17, further comprising a top plate cooperatively connected to said top end of said second framing member.

20. The wall framing system of claim 17, wherein said fastening means comprising a steel strap having a pluarlity of holes cooperatively connected to said top end of said first framing member and said bottom end of said second framing member.

21. The wall framing system of claim 17, wherein said fastening means further comprises a gang nail connector cooperatively connected to said top end of said first framing member and said bottom end of said second framing member.

22. The wall framing system of claim 17, further comprising means for securing said bottom ends of said first framing member to a footing.

23. The wall framing system of claim 22, wherein said securing means comprises an angle cooperatively connected to said bottom end of said first framing member for welding to a steel plate embedded in the footing, whereby said wall panel is aligned in the vertical plane.

24. The wall framing system of claim 17, wherein said first and second framing members form a continuous cavity, whereby any insulation installed may be continuous from said top end of said second framing members to said bottom end of said second framing members.

25. A method of making a one-step foundation and wall comprising:

(a) prefabricating a plurality of wall panels, said wall panels comprising:
  (i) a plurality of spaced rigid framing members, each of said framing members having a top section and a bottom section, said top and bottom sections forming said rigid framing members;
  (ii) a foundation grade treated sheathing cooperatively connected to said bottom section;
  (iii) an external sheathing cooperatively connected to said top section; and
  (iv) means for securing said framing member to a footing;
(b) securing one of said wall panels to a footing;
(c) securing another of said wall panels to a footing, said another of said wall panels abutting said one of said wall panels;
(d) fastening one of said panels to said another of said panels; and
(e) continuing securing additional wall panels to the footing and adjacent wall panels until the building construction is complete.

* * * * *